US005893836A

United States Patent [19]

Raines

[11] Patent Number: 5,893,836

[45] Date of Patent: Apr. 13, 1999

[54] WATER POWERED VIBRATING DEVICE

[75] Inventor: William A. Raines, Ballwin, Mo.

[73] Assignee: Imagineered Products L.L.C., Ballwin, Mo.

[21] Appl. No.: 08/810,452

[22] Filed: Mar. 4, 1997

[51] Int. Cl.[6] ..... A61H 9/00; A61H 23/04

[52] U.S. Cl. ..... 601/69; 601/75; 601/88; 601/155; 601/169

[58] Field of Search ..... 601/75, 46, 55, 601/69, 88, 96, 105, 112, 114, 149, 150, 154, 155, 159, 160, 169

[56] References Cited

U.S. PATENT DOCUMENTS

| | | | |
|---|---|---|---|
| 823,471 | 6/1906 | Knickerbocker . | |
| 890,709 | 6/1908 | Richwood . | |
| 1,225,752 | 5/1917 | Behm . | |
| 1,455,291 | 5/1923 | Hoffman . | |
| 1,948,167 | 2/1934 | Cornwell . | |
| 2,305,982 | 12/1942 | Morando . | |
| 2,703,081 | 3/1955 | Haines . | |
| 3,283,352 | 11/1966 | Hu . | |
| 4,033,338 | 7/1977 | Iqwebike . | |
| 4,313,432 | 2/1982 | Sievers . | |
| 4,458,676 | 7/1984 | Pileggi . | |
| 4,640,462 | 2/1987 | Stearns, III | 239/383 |
| 5,070,864 | 12/1991 | Lemons . | |
| 5,187,827 | 2/1993 | Wei . | |
| 5,293,659 | 3/1994 | Rief et al. . | |

FOREIGN PATENT DOCUMENTS

| | | | |
|---|---|---|---|
| 1350133 | 5/1991 | U.S.S.R. | 601/160 |

*Primary Examiner*—Danton D. DeMille
*Attorney, Agent, or Firm*—Grace J. Fishel

[57] ABSTRACT

A water powered vibrating device has a self-propelled eccentric mass that rotates about a shaft in a casing. A pad is supported on the casing, making contact with the casing along a plane substantially parallel to the axis of rotation. A vibration is generated when the self-propelled eccentric mass rotates on the shaft, which vibration is transmitted to the casing providing a strong kneading and rubbing action on the pad with substantially no component of force parallel to the axis of rotation.

8 Claims, 2 Drawing Sheets

WATER POWERED VIBRATING DEVICE

BACKGROUND OF THE INVENTION

1. Field of the Invention

The present invention relates to a water powered vibrating device that imparts a strong kneading and rubbing action to a pad.

2. Brief Description of the Prior Art

The beneficial effect of massage and warm water on stresses or minor aches and pains is well known and there are numerous massaging devices for personal use. The ones that provide a strong kneading action, i.e., "Swedish Massagers," are electrically powered and cannot be used in a shower or bathtub. The ones that are water powered, on the other hand, do not exert a downward kneading force, or not enough force. The term "downward" as used herein means the direction in which the massager is pressed to bring it into contact with the user's skin.

There are water powered massagers that make use of an unbalanced impeller. Most of these devices operate by spraying a stream of high velocity water on the impeller. Such devices are capable of giving a weak kneading action when the impeller is mounted for rotation about an axis that is parallel to the plane of contact with the user's skin. The transfer of kinetic energy from the water to the impeller is inefficient, however, because the spray diverges as it leaves the nozzle and loses some of its velocity before it impacts the impeller. These factors limit the amount of eccentric weight that can be carried by the impeller and/or reduce the speed at which the impeller is rotated, thereby limiting the amount of downward force.

There is a water powered massager described in U.S. Pat No. 4,640,462 to Stearns, III wherein water is sprayed from a nozzle, providing for more efficient transfer of kinetic energy. In this device, however, the axis of rotation is perpendicular to the plane of contact with the user's skin so that the device provides a rubbing, but no kneading action. The patentee recognized the desirability of having a downward component of force by selectively aiming the nozzle at the user's skin. This gave a simulated, pulsating spray effect, but reduced the speed at which the nozzle rotated, thereby reducing the rubbing force. In addition, the mass of water forming the eccentric weight is limited to the volume of water in the nozzle and the conduit leading to the nozzle, which also limits the rubbing force.

SUMMARY OF THE INVENTION

In view of the above, it is an object of the present invention to provide a water powered vibrator with an unbalanced self-propelled eccentric mass that provides a strong kneading force. It is another object to provide a water powered vibrator wherein kinetic energy is efficiently transferred to the self-propelled eccentric mass. Other objects and features of the invention will be in part apparent and in part pointed out hereinafter.

In accordance with the invention, a water powered vibrating device includes a rotor in a casing with a pad supported by the casing. The casing has a water inlet adapted to be attached to a source of water under pressure and a water outlet. The rotor includes a shaft and an self-propelled eccentric mass. The shaft is journaled in the casing and has a chamber adapted to hold water, with the chamber flowably connected to the water inlet. The self-propelled eccentric mass comprises an elongated member and a coupling. The elongated member has a longitudinal axis and a chamber adapted to hold water, with the longitudinal axis generally parallel to the axis of the shaft. The elongated member depends from and is flowably connected to the shaft by the coupling. The elongated member includes an orifice restricting the flow of water from the elongated member and directing it in a direction such that the self-propelled eccentric mass rotates on the shaft in the casing. The elongated member is adapted to hold a mass of water so that the center of mass of the rotor is offset from the axis of rotation. The pad makes contact with the casing preferably along a plane substantially parallel to the axis of rotation.

A vibration is generated when the self-propelled eccentric mass rotates on the shaft. The vibration is transmitted to the casing providing a strong kneading action on the pad, applied in a direction perpendicular to the pad. The rotor also imparts a rubbing action on the pad parallel to the pad with substantially no component of force parallel to the axis of rotation.

The invention summarized above comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
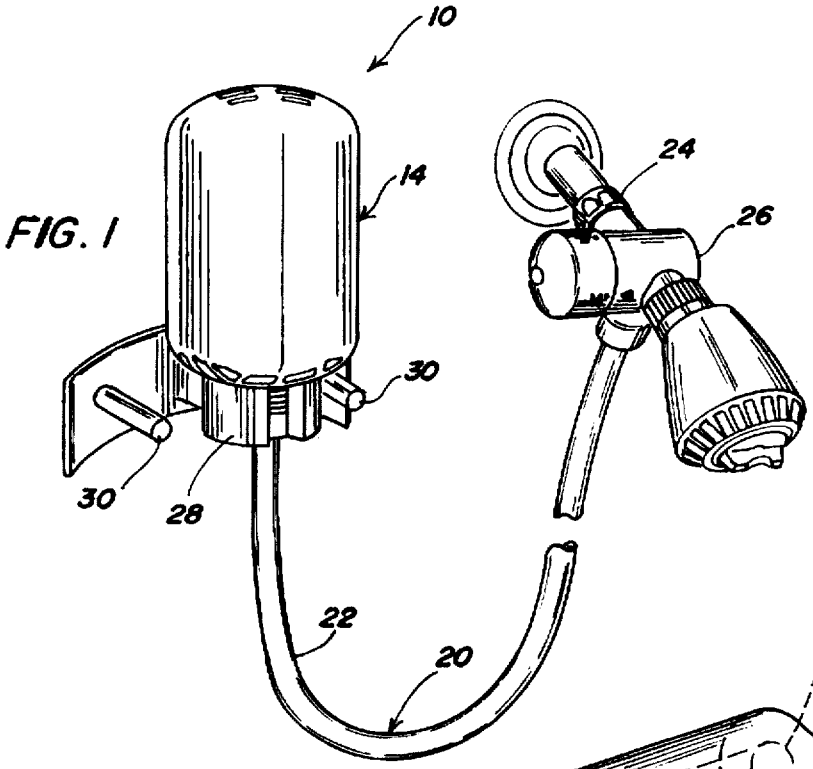
FIG. 1 is a perspective view of a water powered vibrating device in accordance with the present invention shown attached to a shower head and hanging on a bracket.

Referring to the drawings more particularly by reference character, reference number 10 refers to a water powered vibrating device in accordance with the present invention. Vibrating device 10 as more particularly described below is particularly useful as a massager and imparts a strong kneading and rubbing action to a massage pad 12, similar to an electric "Swedish massager." Instead of electricity, however, device 10 uses a small amount of flowing water, providing a far better massage than can be achieved with a pulsed water spray directed at the user's body or with previous water powered massagers with an unbalanced impeller. For example, at 40 PSI water pressure, vibrating device 10, as more particularly described below, can operate on as little as about 1.2 gallons of water per minute such that it can be used even where shower flow is limited, for example, to 2.5 gallons per minute, as it is in many states and local jurisdictions, without interfering with the shower.

Figure 2:
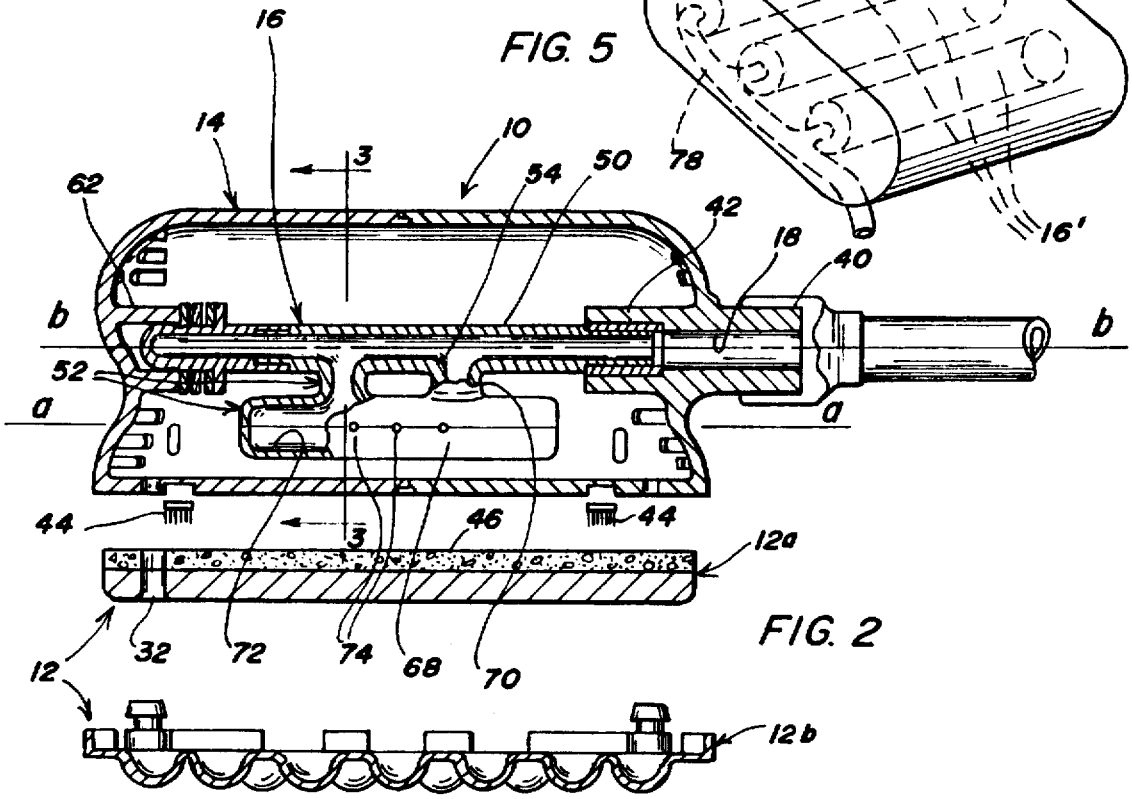
FIG. 2 is a side elevation in section of the water powered vibrating device, with two massage pads for alternative attachment.

In major part, device 10 includes a casing 14, a rotor 16 and massage pad 12. Massage pad 12 can have any desired surface characteristics, for example, it may be a soft sponge or a loofah, a rubberized material with fingers or nubs, etc. Two massage pads, 12*a* and 12*b*, are shown in FIG. 2, for alternative attachment to casing 14. Casing 14 has a water inlet 18 which is connected to a source of water under pressure 20. In the form illustrated, source of water under pressure 20 includes a hose 22, one end of which is attached to water inlet 18, and the other end of which is attached to a water tap 24 such as a shower head, water spigot or the like. As shown in FIG. 1, water tap 24 includes a shower pipe with a valve 26 for diverting the flow of the water through the shower head only, through device 10 only or for selectively splitting the amount of water flowing through the device and through the shower head. By selecting the amount of water flowing through device 10, via the user's shower control valve (not shown), a user can control the impact force of the massager, conforming the device to his or her particular needs. With continuing reference to FIG. 1, a bracket 28 may be provided for hanging device 10 next to a shower head and pegs 30 may be provided on the bracket for hanging massage pads not in current use, massage pad 12*a* being provided with a hole 32 for this purpose.

Figure 3:
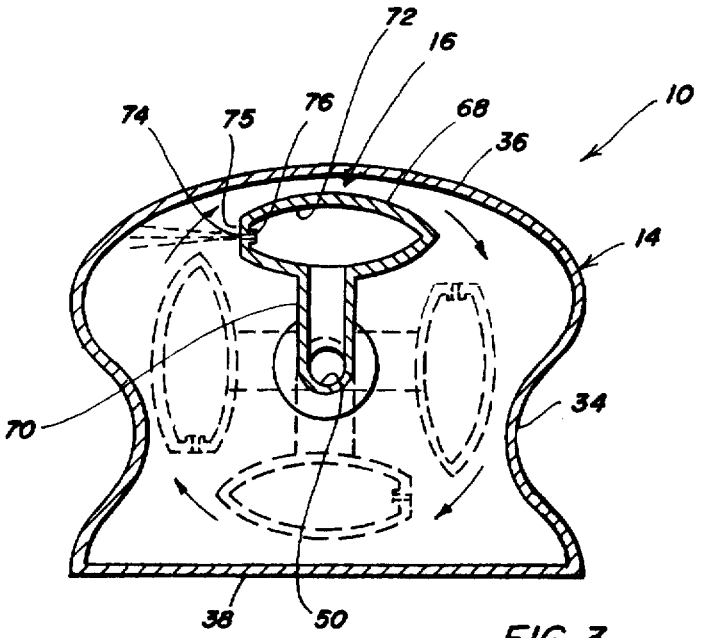
FIG. 3 is a sectional view taken along line 3—3 in FIG. 2.
Figure 4:
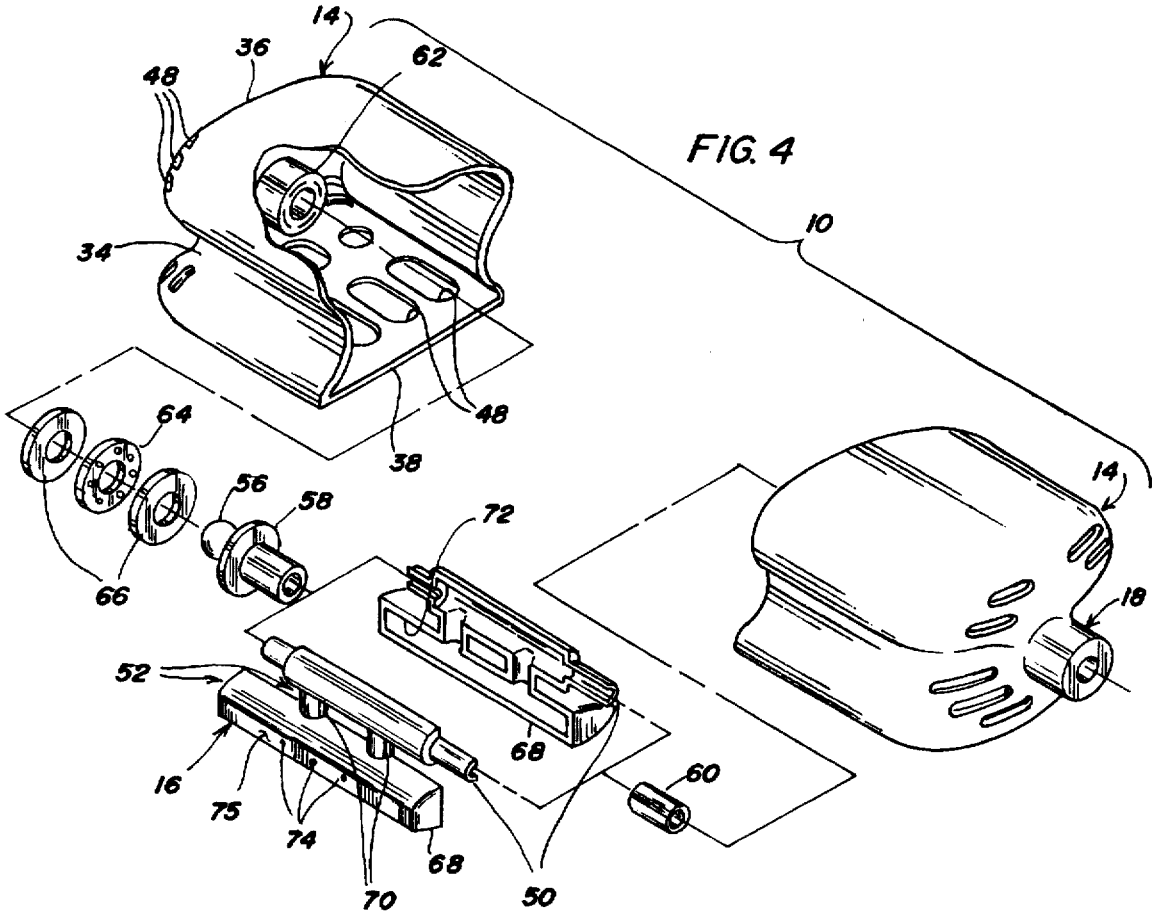
FIG. 4 is an exploded, perspective view of the water powered vibrating device with the massage pad removed; and, FIG. 5 is a perspective view of a second water powered vibrating device in accordance with the present invention.

Casing 14 can take a wide variety of shapes and forms, two of which are shown in the drawings. As shown in FIGS. 1–4, casing 14 has sidewalls 34, a top 36 and a flat bottom 38. Casing 14 may be box shaped and ergonomically designed with sidewalls 34 curved so that casing 14 is hourglass in cross-section with top 36 rounded to fit the palm of a user's hand. As best seen in FIG. 4, casing 14 may be formed from two mating sections. Water inlet 18 is formed in one of sidewalls 34 and includes a nipple 40 to which hose 22 is attached. Nipple 40 constitutes the outer extension of an internal conduit 42 for use as described below. Massage pad 12 is attached to flat bottom 38 by suitable attachment means 44 such as hook and pile fasteners, clips or the like. When a layer 46 of open celled material is attached to the bottom of massage pad 12*a*, attachment means 44 may take the form of barbs which catch in material 46. In other instances, when massage pad 12*b* has a nubby surface, it may include buttons which snap into holes provided in casing 14. Casing 14 includes a water outlet 48 such as a plurality of apertures in bottom 38 and sidewalls 34. Water outlet 48 drains the water from casing 14 so that it does not interfere with the rotation of rotor 16, the apertures in sidewalls 34 being called into play particularly when massage pad 12 is impervious or when, for example, the glue attaching a sponge or loofah to material 46 stops the free flow of water through the sponge or loofah. Impervious glue for attachment of material 46 is desirable for a sponge or loofah as the glue keeps the soap applied to the sponge or loofah from being immediately rinsed away by the water.

Rotor 16 comprises a shaft 50 and an self-propelled eccentric mass 52 which may be integrally molded as one piece, in sections of opposite hand as shown in FIG. 4. Shaft 50 is journaled in casing 14 and includes a chamber 54 adapted to hold water. Chamber 54 is flowably connected to water inlet 18. With reference to FIGS. 1–4, shaft 50 is hollow and is connected at a first end to water inlet 18 and is closed at a second end with a cap 56. Cap 56 includes an abutment shoulder 58. As best seen in FIG. 4, a metal sleeve 60 is provided in internal conduit 42 into which first end of shaft 50 is inserted. The fit between internal conduit 42 and sleeve 60 is snug but permits the rotation of the sleeve in the conduit. Sleeve 60 provides a durable, smooth bearing surface that is lubricated with water forced into the bearing by source of water under pressure 20. An open ended receiver is provided on one of sidewalls 34 opposing internal conduit 42. Cap 56 is supported by abutment shoulder 58 in receiver 62 so as to minimize friction. A lubricant may be provided inside receiver 62 to lubricate the outside of cap 56 and an axial thrust bearing 64 is provided between abutment shoulder 58 and open ended receiver 62. In the form illustrated in the drawings, axial thrust bearing 64 is a nonseparable caged unit including balls in a plastic race. To further reduce friction, axial thrust bearing 64 is sandwiched between two hardened steel washers 66 which remain stationary with respect to shoulder 58 and second open ended receiver 62.

Self-propelled eccentric mass 52 comprises an elongated member 68 with a longitudinal axis (a—a in FIG. 2) which is generally parallel to the axis of shaft 50 (b—b in FIG. 2) and a coupler 70. Elongated member 68 includes a chamber 72 adapted to hold water. Elongated member 68 depends from and is flowably connected to chamber 54 in shaft 50 by coupler 70. As shown in FIGS. 1–4, coupler 70 is a hollow leg, radially extending from shaft 50, preferably provided as a spaced pair of legs, adjacent opposite ends of elongated member 68. Elongated member 68 is preferably lenticular in cross-section. This shape minimizes aerodynamic drag and maximizes the amplitude of the vibrations by placing the center of effort closer to the outside diameter of rotation. Elongated member 68 has an orifice 74 forming a nozzle restricting the flow of water so that the water flowing though orifice 74 is at a higher velocity than the water being supplied to device 10. When elongated member 68 is lenticular, one apex is preferably truncated to form a flat face 75 and orifice 74 is preferably formed in the flat face as best seen in FIG. 3. Orifice 74 includes an inner extension 76 for the purpose of collimating the water as it exits the orifice, improving efficiency. Orifice 74 sprays the water in a direction such that self-propelled eccentric mass 52 rotates on shaft 50. It will be understood that for a given flow rate of water, the rate of rotation of rotor 16 will decrease as the direction of the orifice is turned away from an angle perpendicular to the axis of shaft 50. Elongated member 68 may be hollow throughout as shown in the drawings or otherwise weighted so that the center of mass of the rotor is offset from the axis of rotation. In a preferred form, the mass of water contained in self-propelled eccentric mass 52 and in particular contained in elongated member 68 is much larger than the mass of water contained in shaft 50 so that the center of gravity is closer to elongated member 68 to maximize the angular momentum as the rotor is rotated, thereby maximizing the kneading and rubbing action on pad 12.

Assembly of water powered massage device 10 is economically achieved by axially assembling the various components as shown in FIG. 4, the right and left sections of shaft 50 and self propelled eccentric mass 52 being glued or solvent welded or otherwise joined together. In operation, water is conducted through water inlet 18 causing self-propelled eccentric mass 52 to rotate on shaft 50, which vibration is transmitted to casing 14 providing a strong kneading action on the massage pad and a rubbing action, with substantially no component of force parallel to the axis of rotation. When the water supplied to device 10 is warm, the device provides a deep, relaxing, real massage.

It will be understood that the vibratory performance of device 10 in terms of strength (i.e., amplitude) and the RPM of rotor 16 are effected by the length, eccentric offset, shape, and cross-sectional size of elongated member 68 and the quantity and size of orifice(s) 74. While the focus of the discussion has been on using device 10 as a massager, it will be apparent that the device may be used for other purposes, such as cleaning, etc., in which case pad 12 may be a brush, steel wool, or other material suitable for the purpose.

Figure 5:
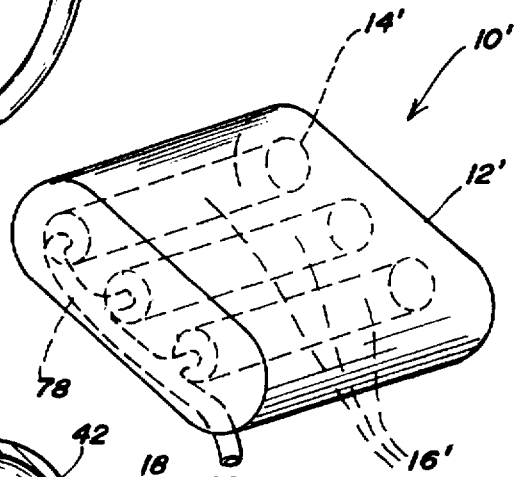

Referring now to FIG. 5, it is seen that device 10' may be provided in a pillow, etc. which may be used, for example, in a hot tub or a bath tub. Device 10' may comprise a plurality of rotors 16' which can be interconnected with a manifold 78 connected to a source of water under pressure. Massage pad 12' may be supported in casings 14' (illustrated as cylindrical), along a plane, or set of planes, substantially parallel to the axis of rotation of rotor 16'. As water flows through device 10', the user is treated with a massage.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A water powered vibrating device comprising a casing with a water inlet adapted to be attached to a source of water under pressure, and a water outlet, a rotor comprising a shaft and an self-propelled eccentric mass, said shaft journaled in the casing and having a first chamber adapted to hold water, said chamber flowably connected to the water inlet, said self-propelled eccentric mass comprising an elongated member and a coupling, the elongated member having a longitudinal axis with a second chamber adapted to hold water, said longitudinal axis generally parallel to the axis of the shaft, said elongated member depending from and flowably connected to the shaft by the coupling, said elongated member having an orifice restricting the flow of water from the elongated member and directing substantially all of the water in a direction generally at a right angle to the longitudinal axis of the elongated member such that the self-propelled eccentric mass rotates on the shaft in the casing, said elongated member adapted to hold a mass of water so that the center of mass of the rotor is offset from the axis of rotation, a pad supported on the casing, said pad making contact with the casing, whereby a vibration is generated when the self-propelled eccentric mass rotates on the shaft, which vibration is transmitted to the casing providing a strong kneading action on the pad and a rubbing action on the pad with substantially no component of force parallel to the axis of rotation.

2. The device of claim 1 wherein the elongated member is lenticular in cross-section with one apex truncated to form a flat face in which the orifice is formed.

3. The device of claim 2 wherein the orifice extends into the chamber in the elongated member whereby the water is collimated as it exits the orifice.

4. A water powered massaging device comprising a casing with sidewalls, a top and a flat bottom, said casing having a water inlet adapted to be attached to a source of water under pressure, and a water outlet;

a rotor comprising a hollow shaft and a self-propelled eccentric mass;

said shaft journaled between the sidewalls for rotation about an axis substantially parallel to the bottom of the casing, said hollow shaft flowably connected to the water inlet at a first end and closed at a second end;

said self-propelled eccentric mass comprising an elongated hollow member with a longitudinal axis, said longitudinal axis generally parallel to the axis of the shaft, said elongated member depending from and flowably connected to the shaft by a hollow leg, said elongated member having an orifice restricting the flow of water from the elongated member and directing it in a direction such that the self-propelled eccentric mass rotates on the shaft in the casing, said elongated member and leg adapted to hold a mass of water substantially greater than the mass contained in the shaft so that the center of mass of the rotor is offset from the axis of rotation; and, a pad supported on the casing, said pad making contact with the casing along a plane substantially parallel to the axis of rotation;

whereby a vibration is generated when the self-propelled eccentric mass rotates on the shaft, which vibration is transmitted to the casing providing a strong kneading action on the pad and a rubbing action on the pad with substantially no component of force parallel to the axis of rotation.

5. The device of claim 4 further comprising an open ended receiver on the sidewalls opposite the water inlet, said shaft being closed at the second end with a cap having an abutment shoulder, said cap received in the open ended receiver and supported in the receiver by the abutment shoulder, an axial thrust bearing between the abutment shoulder and the open ended receiver to reduce friction.

6. The device of claim 5 wherein the axial thrust bearing is sandwiched between a pair of hardened steel washers which remain stationary with respect to the abutment shoulder and the receiver.

7. The device of claim 4 wherein the elongated member is lenticular in cross-section with one apex truncated to form a flat face in which the orifice is formed.

8. The device of claim 7 wherein the orifice extends into the chamber in the elongated member whereby the water is collimated as it exits the orifice.

* * * * *